US008145110B2

(12) United States Patent
Condello et al.

(10) Patent No.: US 8,145,110 B2
(45) Date of Patent: Mar. 27, 2012

(54) APPARATUSES USEFUL FOR PRINTING AND CORRESPONDING METHODS

(75) Inventors: Anthony S. Condello, Webster, NY (US); Augusto E. Barton, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 424 days.

(21) Appl. No.: 12/405,496

(22) Filed: Mar. 17, 2009

(65) Prior Publication Data

US 2010/0237559 A1 Sep. 23, 2010

(51) Int. Cl.
*G03G 15/20* (2006.01)

(52) U.S. Cl. ..... 399/323; 399/328

(58) Field of Classification Search ..... 399/71, 399/122, 123, 320, 322, 323, 327–329; 219/219, 219/469–471
See application file for complete search history.

(56) References Cited

U.S. PATENT DOCUMENTS

| | | | | |
|---|---|---|---|---|
| 7,398,045 | B2 * | 7/2008 | Uehara et al. | 399/329 |
| 7,817,950 | B2 * | 10/2010 | Burton et al. | 399/323 |
| 7,970,330 | B2 * | 6/2011 | Condello et al. | 399/329 |
| 2006/0210331 | A1 | 9/2006 | Baba et al. | |
| 2007/0048035 | A1 | 3/2007 | Baba et al. | |
| 2007/0048042 | A1 | 3/2007 | Uehara et al. | |
| 2007/0092277 | A1 | 4/2007 | Miyata et al. | |
| 2007/0166084 | A1 | 7/2007 | Yoshino et al. | |
| 2007/0172272 | A1 | 7/2007 | Miyata et al. | |

* cited by examiner

*Primary Examiner* — Hoan Tran
(74) *Attorney, Agent, or Firm* — Ronald E. Prass, Jr.; Prass LLP

(57) ABSTRACT

Apparatuses useful for printing and methods of cleaning debris from a surface in an apparatus useful for printing are provided. An exemplary embodiment of an apparatus useful for printing includes a first roll, a belt including an inner surface and an outer surface, the first roll and the outer surface of the belt forming a nip, a stripping member located between the inner surface of the belt and the first roll for facilitating stripping of media from the outer surface of the belt after the media is fed through the nip with the belt moving in a first direction, wherein debris builds up on the inner surface of the belt adjacent to the stripping member during stripping of the media, and a cleaning device for cleaning the debris from the inner surface of the belt upon movement of the belt in a second direction opposite to the first direction.

20 Claims, 6 Drawing Sheets

APPARATUSES USEFUL FOR PRINTING AND CORRESPONDING METHODS

BACKGROUND

In some printing apparatuses, images are formed on media using a marking material. Such printing apparatuses can include a roll and a belt that define a nip. Media are fed to the nip and heated to treat the marking material. The media is typically stripped from the belt, and debris can build up on the belt at a location where the belt meets a stripping member. This may damage the belt, which may cause image degradation on the media.

It would be desirable to provide apparatuses useful for printing and methods that can strip media from surfaces with a stripping member, where debris on the belt may be removed.

SUMMARY

Apparatuses useful for printing and methods of cleaning debris from a surface in an apparatus useful for printing are provided. An exemplary embodiment of an apparatus useful for printing includes a first roll, a belt including an inner surface and an outer surface, the first roll and the outer surface of the belt forming a nip, a stripping member located between the inner surface of the belt and the first roll for facilitating stripping of media from the outer surface of the belt after the media is fed through the nip with the belt moving in a first direction, wherein debris builds up on the inner surface of the belt adjacent to the stripping member during stripping of the media, and a cleaning device for cleaning the debris from the inner surface of the belt upon movement of the belt in a second direction opposite to the first direction.

DRAWINGS

DETAILED DESCRIPTION

Figure 1:
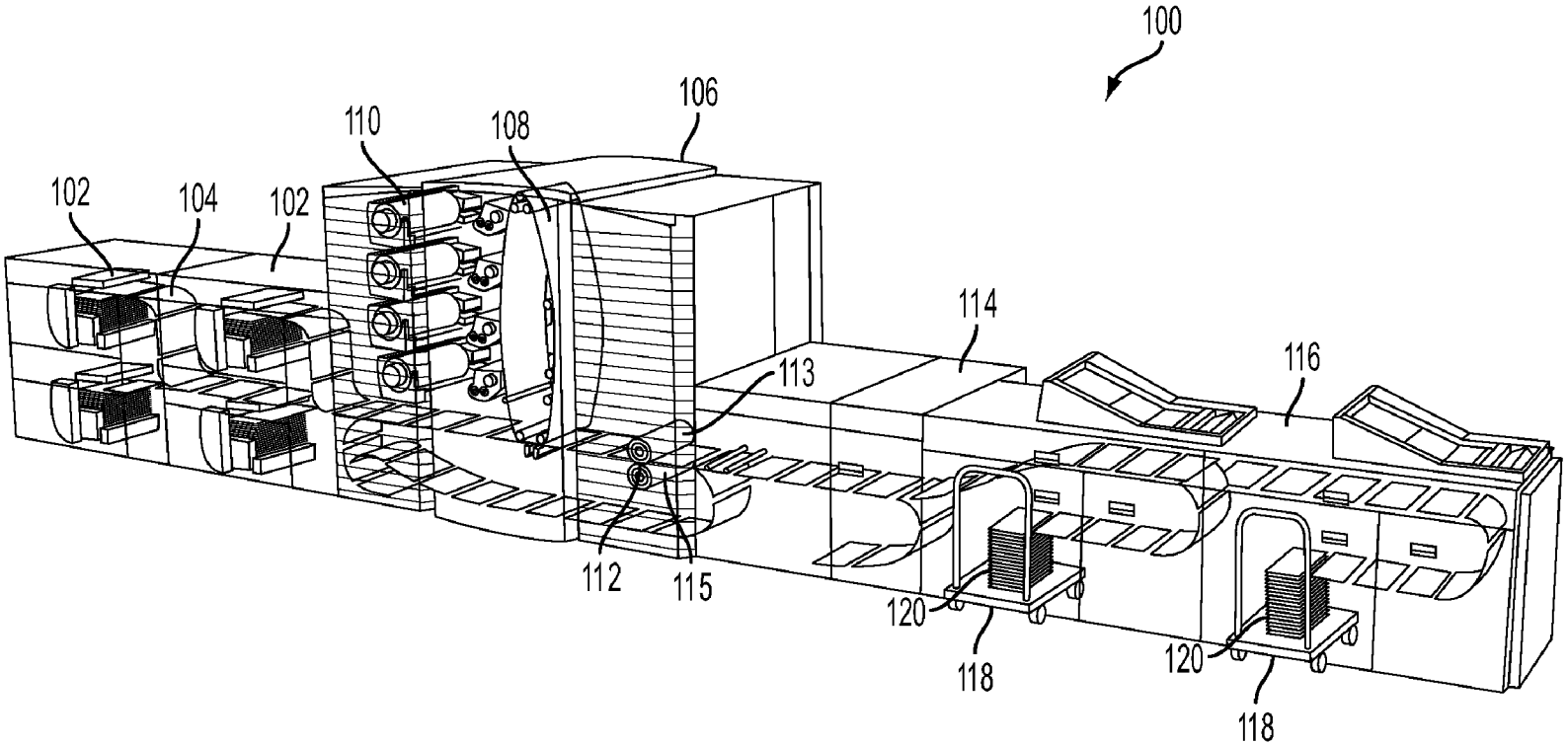
FIG. 1 depicts an exemplary embodiment of a printing apparatus.

The disclosed embodiments include an apparatus useful for printing. The apparatus includes a first roll, a belt including an inner surface and an outer surface, the first roll and the outer surface of the belt forming a nip, a stripping member located between the inner surface of the belt and the first roll for facilitating stripping of media from the outer surface of the belt after the media is fed through the nip with the belt moving in a first direction, wherein debris builds up on the inner surface of the belt adjacent to the stripping member during stripping of the media, and a cleaning device for cleaning the debris from the inner surface of the belt upon movement of the belt in a second direction opposite to the first direction.

The disclosed embodiments further an apparatus useful for printing that includes a first roll, a second roll, a belt disposed between the first roll and second roll, the belt including an inner surface and an outer surface forming a nip, a stripping member located between the second roll and the inner surface of the belt for facilitating stripping of media from the outer surface of the belt after the media is fed through the nip with the belt moving in a first direction, wherein debris builds up on the inner surface of the belt adjacent to the stripping member, a controller for controlling a direction of movement of the belt, the controller causing the belt to move in the first direction when the media is fed to the nip and then stripped from the belt, and selectively causing the belt to move in a second direction opposite to the first direction to clean the debris built up on the inner surface of the belt, and a cleaning device for cleaning the debris from the inner surface of the belt upon movement of the belt in the second direction opposite to the first direction.

The disclosed embodiments further include a method of cleaning debris from a surface in an apparatus useful for printing, the apparatus comprising a first roll, a belt including an inner surface and an outer surface, and a nip formed by the first roll and the outer surface of the belt. The method includes contacting the medium with the outer surface of the belt at the nip, stripping the first medium from the belt using the stripping member after the media is fed through the nip with the belt moving in a first direction, wherein debris builds up on the inner surface of the belt adjacent to the stripping member during stripping of the media, controlling the belt to move in the first direction when the media is fed to the nip and then stripped from the belt, selectively controlling the belt to move in a second direction opposite to the first direction, and cleaning the debris from the inner surface of the belt with a cleaning device upon movement of the belt in the second direction opposite to the first direction.

As used herein, the term "printing apparatus" encompasses any apparatus that performs a print outputting function for any purpose. Such apparatuses can include, e.g., a digital copier, bookmaking machine, multifunction machine, and the like. The printing apparatuses can use various types of solid and liquid marking materials, including toner and inks (e.g., liquid inks, gel inks, heat-curable inks and radiation-curable inks), and the like. The printing apparatuses can use various thermal, pressure and other conditions to treat the marking materials and form images on media.

The embodiments use reversal of the direction of the belt to clean debris that builds up on the inner surface of the belt at a location where the stripping member contacts with the inner surface of the belt. The debris may be a combination of polyimide and silicone oil, although other types of debris could also be present. If the debris is not removed, it could result in the belt becoming embossed or otherwise damaged resulting in image defects to the media.

When using a stationary stripping member that stays in contact with the belt, the debris can be trapped at a stripping edge where the belt contacts with the corner of the stripping member. Therefore, cleaning the belt after the stripping member in the process direction will not be effective because the debris is trapped at the interface. Accordingly, the embodiments cause reversal of the direction of the belt to dislodge the debris from the interface between the belt and the stripping member, and clean the debris from the inner surface of the belt with a cleaning device. The cleaning device may thus be upstream of the stripping member and the nip.

FIG. 1 illustrates an exemplary printing apparatus 100 as disclosed in U.S. Patent Application Publication No. 2008/0037069, which is incorporated herein by reference in its entirety. The printing apparatus 100 can be used to produce prints with different media types.

The printing apparatus 100 includes two media feeder modules 102 arranged in series, a printer module 106 adjacent the media feeding modules 102, an inverter module 114 adjacent the printer module 106, and two stacker modules 116 arranged in series adjacent the inverter module 114. In the printing apparatus 100, the media feeder modules 102 feed media to the printer module 106. In the printer module 106, toner is transferred from a series of developer stations 110 to a charged photoreceptor belt 108 to form toner images on the photoreceptor belt 108 and produce color prints. The toner images are transferred to respective media 104 fed through the paper path. The media are advanced through a fuser 112 including a fuser roll 113 and pressure roll 115, which form a nip where heat and pressure are applied to the media to fuse toner images onto the media. The inverter module 114 manipulates media exiting the printer module 106 by either passing the media through to the stacker modules 116, or inverting and returning the media to the printer module 106. In the stacker modules 116, the printed media are loaded onto stacker carts 118 to form stacks 120.

Figure 2:
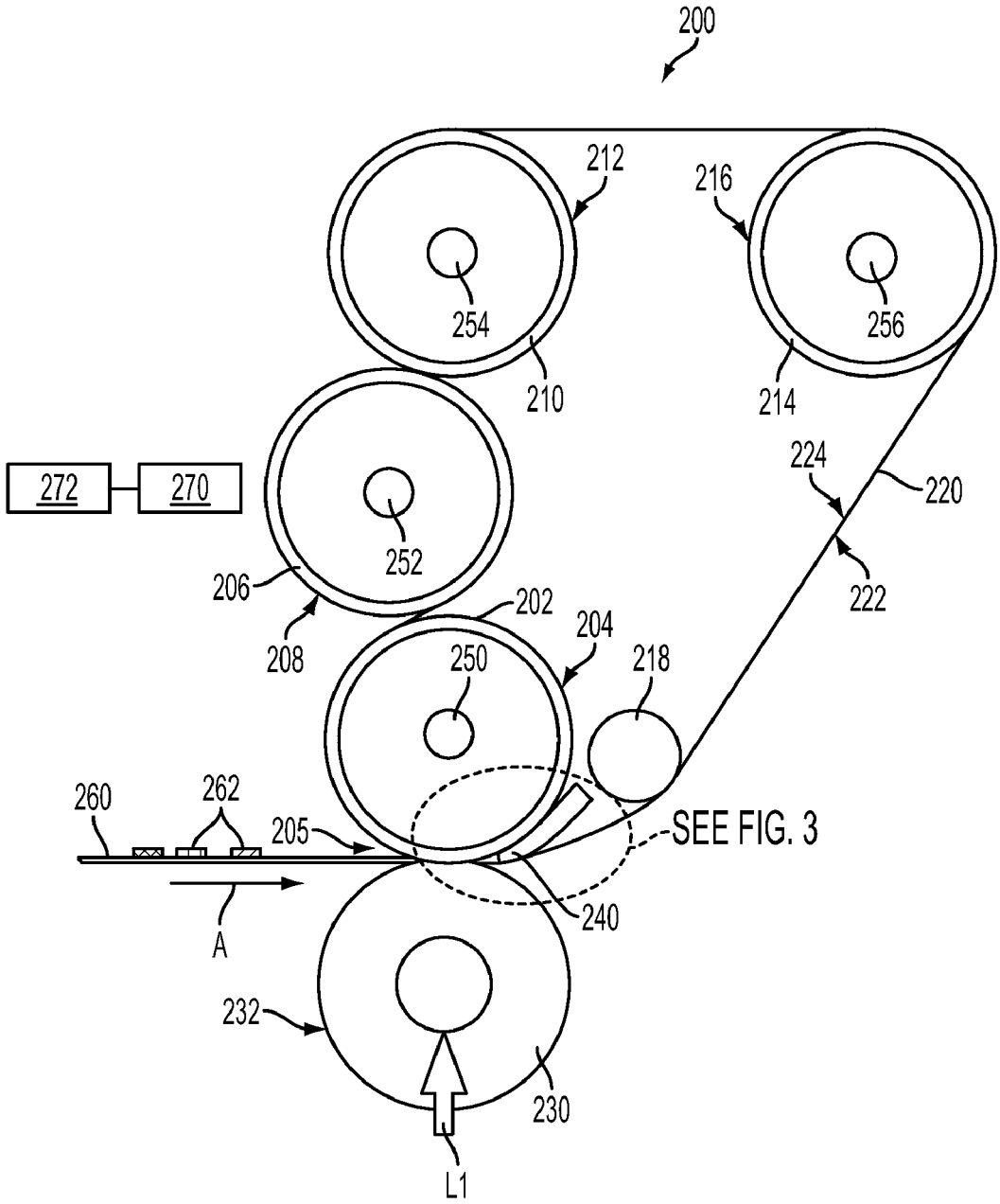
FIG. 2 depicts an exemplary embodiment of a fuser.

FIG. 2 illustrates an exemplary embodiment of an apparatus useful for printing. The apparatus may be a fuser 200. The fuser 200 is constructed to facilitate stripping of different media types that may be used in the fuser 200. Embodiments of the fuser 200 can be used with different types of printing apparatuses. For example, the fuser 200 can be used in place of the fuser 112 in the printing apparatus 100 shown in FIG. 1.

As shown in FIG. 2, the fuser 200 includes a continuous belt 220 provided on a fuser roll 202, external roll 206, internal rolls 210, 214 and an idler roll 218. The belt 220 has an outer surface 222 and an inner surface 224. In other embodiments, the fuser 200 can include less than, or more than, four rolls supporting the belt 220.

The fuser roll 202, external roll 206 and internal rolls 210, 214 have outer surfaces 204, 208, 212 and 216, respectively, contacting the belt 220. The fuser roll 202, external roll 206 and internal rolls 210, 214 may include internal heating elements 250, 252, 254 and 256, respectively. The heating elements 250, 252, 254 and 256 can be, e.g., axially-extending lamps. The heating elements are connected to a power supply 270 in a conventional manner. In embodiments, each of the fuser roll 202, external roll 206, and internal rolls 210, 214 can include more than one heating element. For example, each of these rolls can include one long lamp and one short lamp. The power supply 270 is connected to a controller 272 in a conventional manner. The controller 272 controls the operation of the power supply 270 to control the supply of voltage to the heating elements 250, 252, 254 and 256, so as to heat the belt 220 to the desired temperature, but may be used to control other elements as well. For example, the controller may be used to selectively control a direction of belt 220. The controller may be connected to a motor that controls movement of the belt 220.

The fuser 200 further includes an external pressure roll 230 having an outer surface 232, which is shown engaging the belt 220. The pressure roll 230 and belt 220 forms a nip 205 between the outer surface 232 and the outer surface 222. In embodiments, the pressure roll 230 includes a core and an outer layer with the outer surface 232 overlying the core. The core can be comprised of aluminum or the like, and the outer layer can be comprised of an elastically deformable polymeric material.

Embodiments of the belt 220 can include, e.g., a base layer, an intermediate layer on the base layer, and an outer layer on the intermediate layer. In such embodiments, the base layer forms the inner surface 224 and the outer layer forms the outer surface 222 of the belt 220. In an exemplary embodiment of the belt 220, the base layer is comprised of a polymeric material, such as polyimide, or the like; the intermediate layer is comprised of silicone, or the like; and the outer layer is comprised of a polymeric material, such as a fluoroelastomer sold under the trademark Viton® by DuPont Performance Elastomers, L.L.C., polytetrafluoroethylene (Teflon®), or the like.

In embodiments, the belt 220 can have a thickness of about 0.1 mm to about 0.6 mm. For example, the belt 220 can include a base layer having a thickness of about 50 μm to about 100 μm, an intermediate layer having a thickness of about 100 μm to about 500 μm, and an outer layer having a thickness of about 20 μm to about 40 μm. The belt 220 can typically have a width of about 350 mm to about 450 mm, and a length of about 500 mm to at least about 1000 mm.

FIG. 2 depicts a medium 260 being fed to the nip 205 in the process direction A. The fuser roll 202 is rotated counter-clockwise and the pressure roll 230 is rotated clockwise to convey the medium 260 through the nip 205 in the process direction A and rotate the belt 220 counter-clockwise. The medium 260 can be, e.g., a paper sheet. Typically, paper is classified by weight. Light-weight paper has a weight of ≦about 75 gsm, medium-weight paper has a weight of about 75 gsm to about 160 gsm, and heavy-weight paper has a weight of ≧160 gsm. Typically, a low toner mass is less than about 0.8 mg/cm$^2$, while a high toner mass is at least about 0.8 mg/cm$^2$. Media can be coated or uncoated. A larger amount of energy (both per thickness and per basis weight) is used to treat marking material on coated media as compared to uncoated media. For example, a higher fusing temperature is used to fuse toner on heavy-weight media as compared to light-weight media.

The outer surface 232 of the pressure roll 230 is deformed by contact with the belt 220 on the fuser roll 202. The outer surface 204 of the fuser roll 202 may also be deformed by this contact depending on the hardness of the material forming the outer surface 204. For example, when the outer surface 204 is made of an elastically deformable material, the outer surface 204 can also be deformed by contact with the pressure roll 230.

The "nip width" is the distance between the nip entrance and the nip exit in the process direction. The nip width can be expressed as the product of the dwell and process speed (i.e., nip width=dwell×process speed). FIG. 2 depicts a case where the medium 260 fed to the nip 205 is a light-weight medium, such as light-weight paper. A marking material 262, e.g., toner, is on a top surface of the medium 260 facing the belt 220. The medium 260 can be coated or uncoated. In this case, the belt 220 and pressure roll 230 forms a small nip width.

Figure 3:
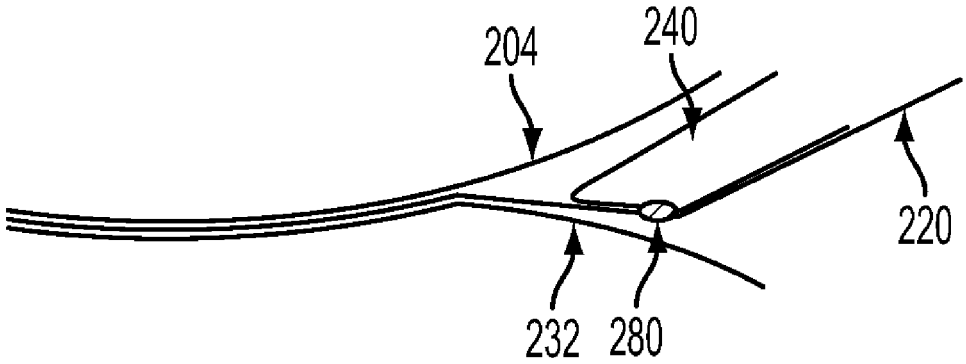
FIG. 3 is an enlarged view of a portion of the fuser shown in FIG. 2.

FIG. 3 depicts the stripping member 240 in contact with the belt 220, with the stripping member 240 being positioned between the inner surface of the belt 220 and the outer surface 204 of the fuser roll 202. As the belt 220 moves across the stripping member 240, debris 280 may build up on the inner surface 224 of belt 220. The debris 280 may become trapped at the interface of the inner surface 224 of belt 220 adjacent to where the stripping member 240 contacts the inner surface. If the debris 280 is left at this location, it may result in the belt becoming embossed or otherwise damaged resulting in image defects to the media.

Accordingly, the embodiments cause reversal of the direction of the belt 220 to dislodge the debris from the interface between the belt 220 and the stripping member 240, and clean the debris 280 from the inner surface 204 of the belt 220 with a cleaning device. During reversal of the direction of the belt 220, the belt 220 may thus be caused to move in a counter-clockwise direction. The cleaning device may be placed upstream of the stripping member 240 and the nip 205.

Figure 4:
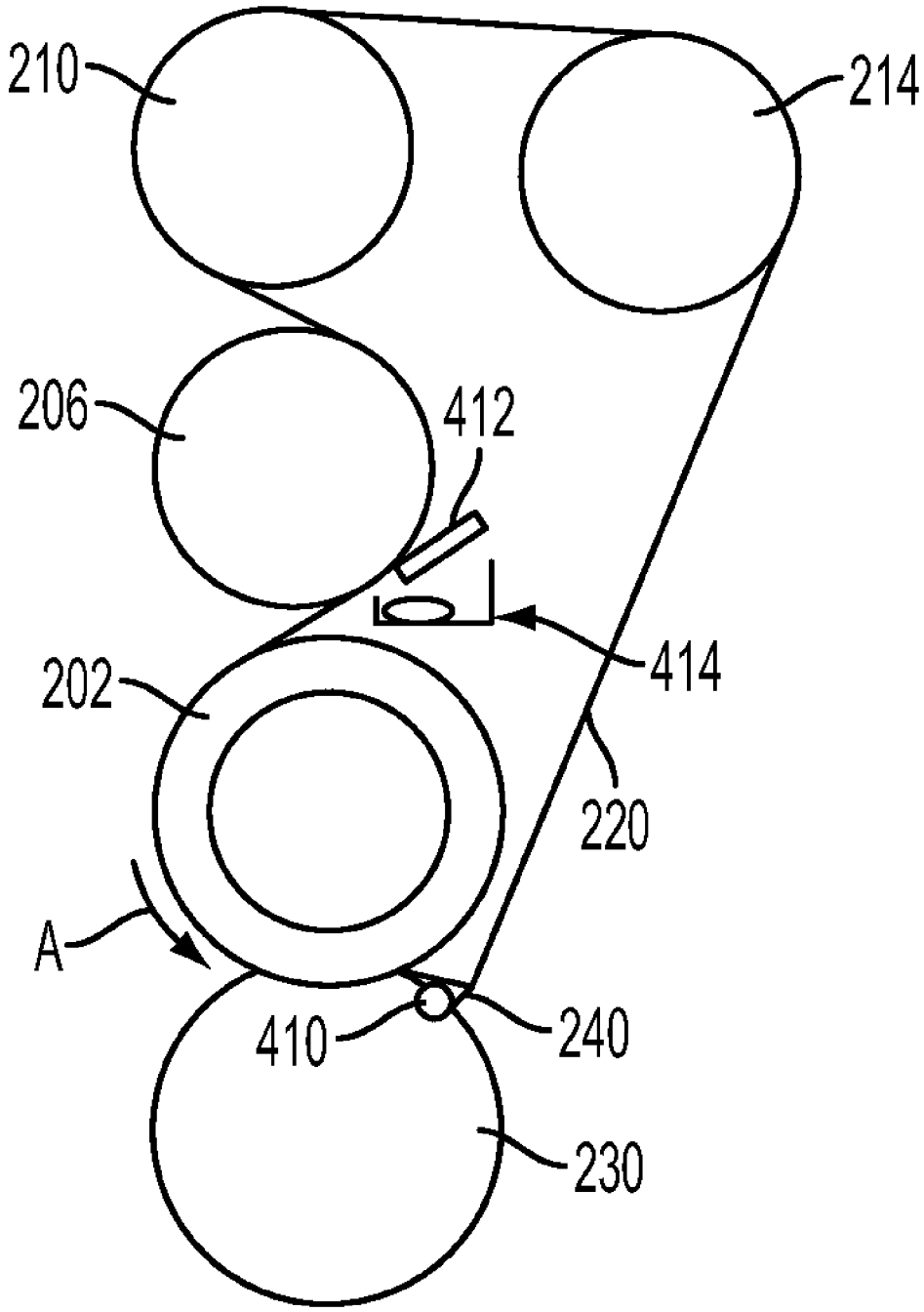
FIG. 4 depicts an exemplary embodiment of a fuser.

FIG. 4 illustrates a portion of the fuser 200 including a cleaning device. The cleaning device may include a blade 412 and a tray 414 into which the debris may be retained after being cleaned from the inner surface 224 of the belt 220. The blade made be rubber, a metal such as steel, a polymer or elastomeric material, or some other material. During normal operation, the belt 220 moves in a counterclockwise direction, in the direction of arrow A. To clean debris 410 from the inner surface 224 of the belt 220 that has become trapped adjacent to the stripping member 240, the direction of the belt 220 may be reversed to be opposite to direction A. This will cause the debris 410 on the inner surface 224 of the belt 220 to be moved to the cleaning device to be cleaned off the belt 220. During this reversal of the direction of belt 220, media is not fed to the nip.

The controller 272 may selectively control the direction of the belt 220 to move in the direction of arrow A during normal operation, and to move in a direction opposite to arrow A during cleaning of the inner surface 224 of belt 220. The controller 272 may reverse the direction to clean the belt based on any desired criteria, such as after a certain running time of the apparatus, after a certain number of revolutions of the belt, after debris is detected such as by a sensor, or manually by a user entering a command through an interface.

The controller 272 may selectively control the direction of the belt 220 to move in the direction of arrow A during normal operation, and to move in a direction opposite to arrow A during cleaning of the inner surface 202 of belt 220. The controller 272 may reverse the direction to clean the belt based on any desired criteria, such as after a certain running time of the apparatus, after a certain number of revolutions of the belt, after debris is detected such as by a sensor, or manually by a user entering a command through an interface.

Figure 5:
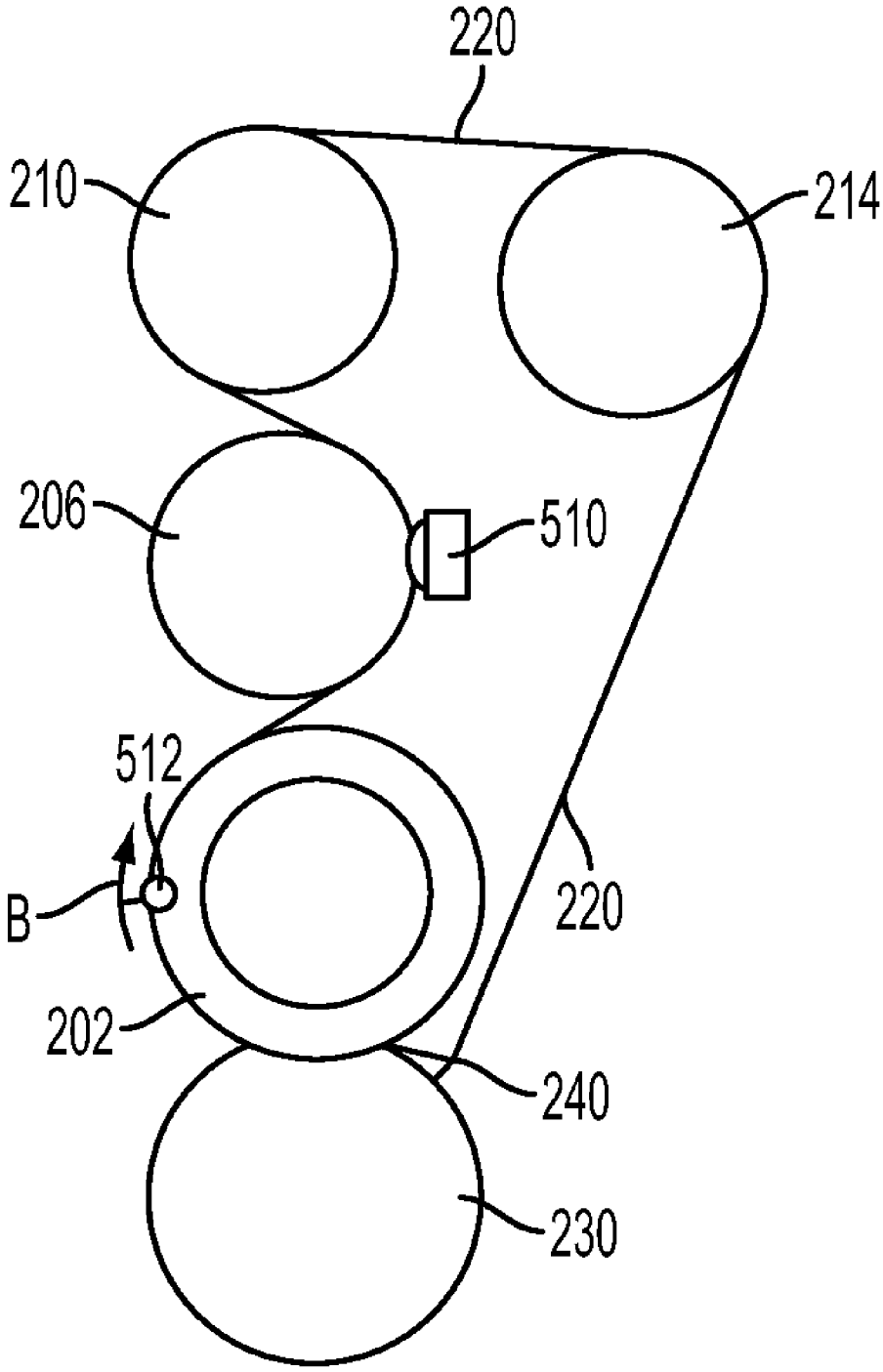
FIG. 5 depicts an exemplary embodiment of a fuser.

FIG. 5 illustrates the fuser 200, with an alternative cleaning device. The cleaning device may be a wick 510, which may include a cloth material that is in contact with the inner surface of belt 220. The wick 510 may be a Nomex material, and may be a woven or no-woven material. When the direction of the belt 220 is reversed, the debris 512 is moved in the direction of arrow B to the wick 510, where the wick 510 cleans the debris 512 from the belt 220.

Figure 6:
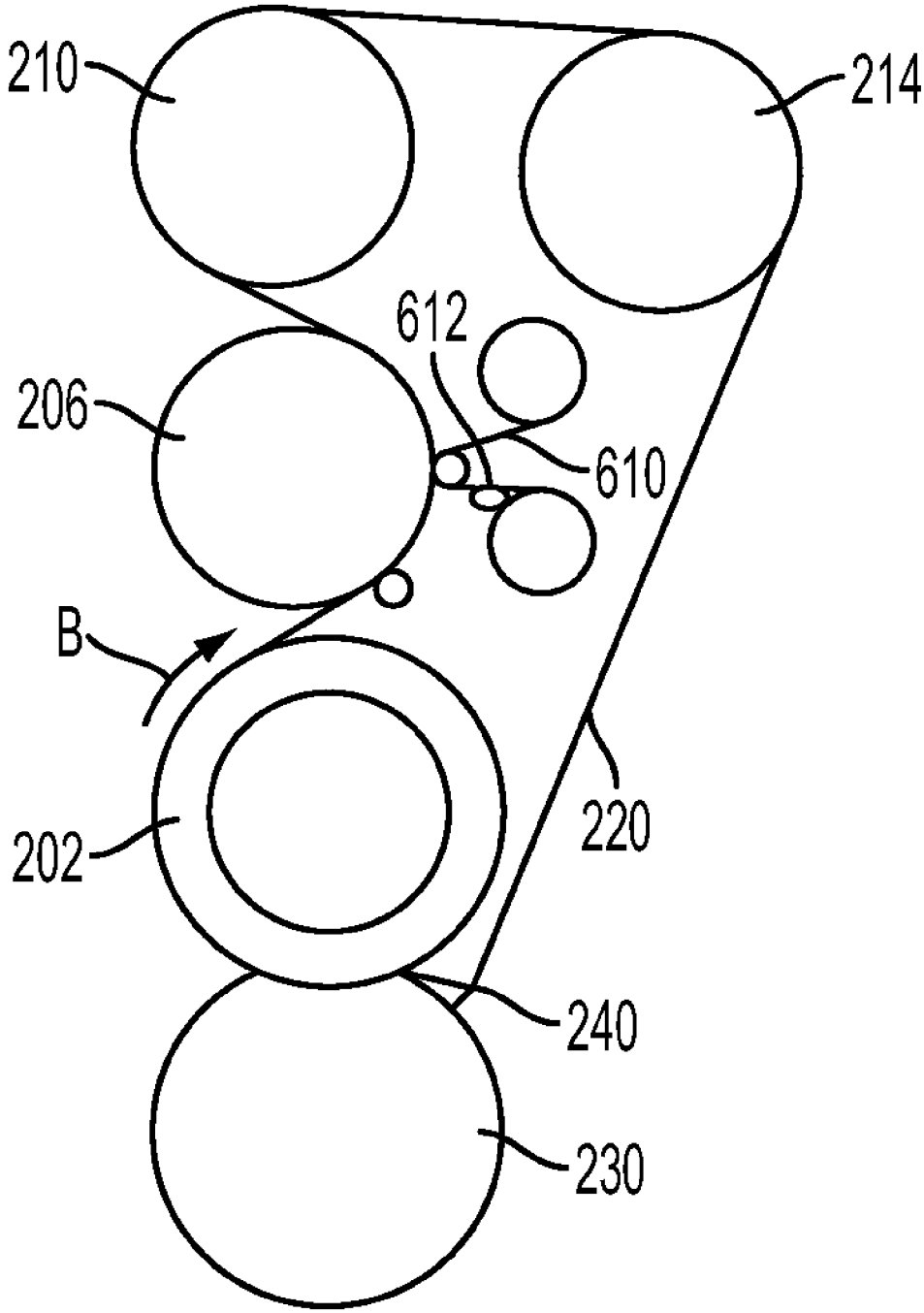
FIG. 6 depicts an exemplary embodiment of a fuser.

FIG. 6 illustrates the fuser 200, with an alternative cleaning device. The cleaning device may be a web device 610. The web device 610 may include a web that may be wound in a predetermined direction by a plurality of rollers. The web may come into contact with the inner surface of belt 220 to clean debris 612 from the belt 220 when the belt 220 is moved in the direction of arrow B.

Embodiments can also be used in apparatuses useful for printing to assist stripping of media from belts that have different structures and functions than fuser belts. For example, the stripping members can be used in printing apparatuses to assist stripping of media from photoreceptor belts used to transfer images to media, and in printing apparatuses to assist stripping of media from intermediate belts used to transport images that are transferred to media. Apparatuses useful for printing can include more than one stripping member for stripping media from more than one belt included in printing apparatuses.

Although the above description is directed toward fuser apparatuses used in xerographic printing, it will be understood that the teachings and claims herein can be applied to any treatment of marking material on a medium. For example, the marking material can be toner, liquid or gel ink, and/or heat- or radiation-curable ink; and/or the medium can utilize certain process conditions, such as temperature, for successful printing. The process conditions, such as heat, pressure and other conditions that are desired for the treatment of ink on media in a given embodiment may be different from the conditions that are suitable for xerographic fusing.

It will be appreciated that various ones of the above-disclosed, as well as other features and functions, or alternatives thereof, may be desirably combined into many other different systems or applications. Also, various presently unforeseen or unanticipated alternatives, modifications, variations or improvements therein may be subsequently made by those skilled in the art, which are also intended to be encompassed by the following claims.

What is claimed is:

1. An apparatus useful for printing, comprising:

a first roll;

a belt including an inner surface and an outer surface, the first roll and the belt forming a nip;

a stripping member located between the inner surface of the belt and the first roll for facilitating stripping of media from the outer surface of the belt after the media is fed through the nip with the belt moving in a first direction, wherein debris builds up on the inner surface of the belt adjacent to the stripping member during stripping of the media; and a cleaning device for cleaning the debris from the inner surface of the belt upon movement of the belt in a second direction opposite to the first direction.

2. The apparatus of claim 1, wherein the cleaning device comprises a blade positioned along the inner surface of the belt.

3. The apparatus of claim 2, wherein the cleaning device further comprises a tray for retaining the debris cleaned from the belt by the blade.

4. The apparatus of claim 3, wherein the cleaning device comprises a wick.

5. The apparatus of claim 4, wherein the wick includes a cloth material in contact with the inner surface of the belt.

6. The apparatus of claim 1, wherein the cleaning device comprises a web device in contact with the inner surface of the belt.

7. The apparatus of claim 6, wherein the web device comprises a web in contact with the inner surface of the belt and a plurality of rollers.

8. The apparatus of claim 1, further comprising a controller, the controller controlling movement of the belt, including a direction of movement of the belt.

9. An apparatus useful for printing, comprising:

a first roll;

a second roll;

a belt disposed between the first roll and second roll, the belt including an inner surface and an outer surface forming a nip;

a stripping member located between the second roll and the inner surface of the belt for facilitating stripping of media from the outer surface of the belt after the media is fed through the nip with the belt moving in a first direction, wherein debris builds up on the inner surface of the belt adjacent to the stripping member;

a controller for controlling a direction of movement of the belt, the controller causing the belt to move in the first direction when the media is fed to the nip and then stripped from the belt, and selectively causing the belt to move in a second direction opposite to the first direction to clean the debris built up on the inner surface of the belt; and a cleaning device for cleaning the debris from the inner surface of the belt upon movement of the belt in the second direction opposite to the first direction.

10. The apparatus of claim 9, wherein the cleaning device comprises a blade positioned along the inner surface of the belt.

11. The apparatus of claim 10, wherein the cleaning device further comprises a tray for retaining the debris cleaned from the belt by the blade.

12. The apparatus of claim 9, wherein the cleaning device comprises a wick.

13. The apparatus of claim 12, wherein the wick includes a cloth material in contact with the inner surface of the belt.

14. The apparatus of claim 9, wherein the cleaning device comprises a web device in contact with the inner surface of the belt.

15. The apparatus of claim 14, wherein the web device comprises a web in contact with the inner surface of the belt and a plurality of rollers.

16. A method of cleaning debris from a surface in an apparatus useful for printing, the apparatus comprising a first roll, a belt including an inner surface and an outer surface, and a nip formed by the first roll and the belt, the method comprising:

contacting a medium with the outer surface of the belt at the nip; and stripping the medium from the belt using a stripping member after the medium is fed through the nip with the belt moving in a first direction, wherein debris builds up on the inner surface of the belt adjacent to the stripping member during stripping of the media;

controlling the belt to move in the first direction when the media is fed to the nip and then stripped from the belt, and selectively controlling the belt to move in a second direction opposite to the first direction; and cleaning the debris from the inner surface of the belt with a cleaning device upon movement of the belt in the second direction opposite to the first direction.

17. The method of claim 16, wherein the cleaning device comprises a blade positioned along the inner surface of the belt and a tray for retaining the debris cleaned from the belt by the blade.

18. The method of claim 16, wherein the cleaning device comprises a wick, and the wick includes a cloth material in contact with the inner surface of the belt.

19. The method of claim 16, wherein the cleaning device comprises a web device in contact with the inner surface of the belt.

20. The method of claim 19, wherein the web device comprises a web in contact with the inner surface of the belt and a plurality of rollers.

* * * * *